US007316035B2

(12) United States Patent
Archambault

(10) Patent No.: US 7,316,035 B2
(45) Date of Patent: Jan. 8, 2008

(54) MULTI-PURPOSE BURP CLOTH

(76) Inventor: Jeffrey A. Archambault, 14989 Mahoe Ct., Ft. Myers, FL (US) 33908

( * ) Notice: Subject to any disclaimer, the term of this patent is extended or adjusted under 35 U.S.C. 154(b) by 386 days.

(21) Appl. No.: 10/744,891

(22) Filed: Dec. 22, 2003

(65) Prior Publication Data

US 2005/0132462 A1 Jun. 23, 2005

(51) Int. Cl.
*A41D 13/04* (2006.01)

(52) U.S. Cl. ..... 2/46; 2/48

(58) Field of Classification Search ..... 2/46, 2/48, 49.1–49.5, 50, 51, 52, 104, 114, 102, 2/88, 69.5, 69; 5/419, 420, 655, 482, 484, 5/413 R; 224/148.6, 148.3; 248/102, 104
See application file for complete search history.

(56) References Cited

U.S. PATENT DOCUMENTS 2,451,718 A * 10/1948 Corrao ..... 248/105
2,482,182 A * 9/1949 Henninger ..... 2/48
2,831,193 A * 4/1958 Terry ..... 2/46
2,955,293 A * 10/1960 Peterson ..... 2/48
3,850,393 A 11/1974 Marquard
3,871,027 A * 3/1975 Orr ..... 2/49.2
4,050,099 A 9/1977 David
4,220,302 A 9/1980 Hampton et al.
4,726,551 A * 2/1988 Randall et al. ..... 248/102
4,809,938 A * 3/1989 Skinner et al. ..... 248/102
4,873,725 A * 10/1989 Mitchell ..... 2/48
D318,772 S * 8/1991 Phillips ..... 5/419
5,570,474 A * 11/1996 Berry et al. ..... 2/104
5,573,153 A 11/1996 Stillman
5,709,000 A * 1/1998 Hansen et al. ..... 5/655
D392,440 S 3/1998 Garza, Jr.
5,898,940 A * 5/1999 Cameron ..... 2/49.1
5,960,471 A * 10/1999 Burton ..... 2/48
6,000,664 A 12/1999 Hood
6,055,667 A * 5/2000 Jimenez ..... 2/49.1

(Continued)

*Primary Examiner*—A. Vanatta
(74) *Attorney, Agent, or Firm*—The Livingston Firm; Edward M. Livingston; Angela M. Miller

(57) ABSTRACT

A multi-purpose burp cloth (1) which allows parents or care-givers to perform other activities while feeding his or her baby by bottle that also acts as a baby diaper changing pad and pacifier holder. The burp cloth (1) has a front side (3) and a back side (8) that are attached to one another by stitching (16). A pillow is located at an upper portion of the burp cloth (1) and a clip (5) is located just below the pillow (2) on the front component (3) while a strap (4) is attached to the front side (3). To use the cloth (1), the user simply wraps the strap (4) around the bottle and attaches the fastening means (14) on a strap outer surface (13) to a fastening means (14) located on a strap inner surface (12). An alternate embodiment includes an adjuster (7) located on a strap pair (18) wherein the user feeds the end portion of the strap (4) through the adjuster (7) and pulls the strap (4) so as to make the strap (4) tight against the bottle (10). To use the cloth (1) as a baby diaper changing pad, the user simply flips the cloth (1) so that the back side (8) is face up, places the baby's head onto the pillow (2) and changes the diaper. The user may then wipe the back side (8) with a disinfecting wipe to kill the germs.

32 Claims, 4 Drawing Sheets

U.S. PATENT DOCUMENTS

D445,903 S 7/2001 Anderson
6,378,135 B1 * 4/2002 Hemming et al. ..... 2/104
6,398,088 B1 6/2002 Burke
7,048,160 B2 * 5/2006 Anderson ..... 224/148.6
7,082,617 B1 * 8/2006 Poindexter et al. ..... 2/48
2005/0066405 A1 * 3/2005 Babiak ..... 2/48
2005/0091723 A1 * 5/2005 Niederhofer ..... 2/49.1

* cited by examiner

MULTI-PURPOSE BURP CLOTH

BACKGROUND OF THE INVENTION

This invention relates to burp cloths, more specifically, a burp cloth that has many functional uses, including: holding a baby bottle in a feeding position, holding a pacifier, use as diaper changing mat and use as a traditional burp cloth.

Multi-tasking has become an art in today's hectic and rushed society. For instance, driving a car used to be a task that one gave his or her full, undivided attention. Nowadays, however, people are known to make telephone calls, eat meals and grooms his or her appearance all while driving a car in order to save time. Cooking and eating have also become tasks in which people simultaneously perform other activities, such as making telephone calls, cleaning the house and washing the laundry. Although the art of multi-tasking has recently come into the public eye, parents and care-givers have practiced it for years.

Although it is difficult, daily tasks, such as paying the bills, answering the telephone and typing on the computer can be performed while caring for a baby so long as the baby is in eyesight. However, when babies are feeding from bottles, 100% attention must be given to baby because the parent or care-giver must hold the baby in one hand and position the bottle with the other. Thus, when the baby is feeding, the parent or care-giver cannot perform any other tasks. If the telephone should ring, the parent or care-giver must either a) not answer the phone or b) remove the bottle from the baby's mouth, set it down and upset the baby. Although parents would love to be able to provide 100% attention to their child during this important time, it is simply impossible. Thus, there exists the need for a device which permits parents or care-givers to perform other activities while feeding his or her baby by bottle.

Additionally, parents and care-givers have grown accustom to hauling around bags of baby items, including diapers, pacifiers, toys, formula, baby wipes, baby bottles, changing pads, burp cloths and other such necessities. However, toting around all the necessities, in addition to the baby, is exhausting. Thus, the need for a device which provides multiple functions for baby-use exists.

Thus, the present invention helps to 1) allow parents or care-givers to feed a baby while having one hand free and 2) allow parents or care-givers to use one device for many baby-related purposes.

The relevant prior art includes the following patents:

| Patent No. (U.S. unless stated otherwise) | Inventor | Issue Date |
|---|---|---|
| 5,573,153 | Stillman | Nov. 12, 1996 |
| 3,850,393 | Marquard | Nov. 26, 1974 |
| 4,220,302 | Hampton et al. | Sep. 02, 1980 |
| 6,000,664 | Hood | Dec. 14, 1999 |
| 6,398,088 | Burke | Jun. 04, 2002 |
| Des. 445,903 | Anderson | Jul. 31, 2001 |
| Des. 392,440 | Garza, Jr. | Mar. 24, 1998 |
| 4,050,099 | David | Sep. 27, 1977 |

Although the above patents teach various types of baby bottle holding burp cloths, none teach a baby bottle holding burp cloth that also performs several other functions, including a diaper changing pad and pacifier holder.

SUMMARY OF THE INVENTION

The primary object of the present invention is to provide a multi-purpose burp cloth that can hold baby bottles of various shapes and sizes in a variety of feeding positions.

A further object of the present invention is to provide a multi-purpose burp cloth that is large enough to drape over a parent or care-giver's shoulder and can absorb baby mucous.

An even further object of the present invention is to provide a multi-purpose burp cloth that acts a diaper changing pad.

A further object of the present invention is to provide a multi-purpose burp cloth that has a pillow for a baby's head for use when the baby's diaper is being changed.

An even further object of the present invention is to provide a multi-purpose burp cloth that holds a pacifier.

The present invention fulfills the above and other objects by providing a multi-purpose burp cloth comprised of four components: a front side, a back side, a pillow and a strap. The front side is made of a soft and absorbent material, preferably terry cloth, in order to absorb any baby mucous a baby may cough up after feeding. The back side is made of an impermeable material, preferably vinyl rubber, to act as a baby-changing pad. Both the front and back sides may be quilted together so as to be durable. The shell of the pillow is made of a soft cloth material while a filling is made of a material that is supportive yet conforms to a baby's head, such as the pellets used in bean bags. The pillow is preferably of a sufficient weight to act as a weight in order to maintain the position of the cloth over a user's shoulder. The strap, which may be a continuous loop, is covered with a material with gripping capability on one side and a material with a fastening means, preferably hook and loop type fastening material, on the other side of the strap. A portion of the strap is releasably attached to the front side of the cloth by securing the fastening means located on the strap to a fastening material located on the front side of the cloth. In addition, the strap may be elasticized so as to expand or permanently secured to the front side of the cloth. A second embodiment of the invention utilizes a pair of straps wherein one end of each strap is attached to the front side of the cloth. The opposite end of the short strap has an adjuster while both sides of the longer strap have a fastening means, preferably hook and loop type fastening material. Another alternate embodiment of the invention utilizes a non-looped strap wherein a central portion of the strap is permanently or releasably secured to the front side of the cloth and fastening means are located on the both sides of the strap so as to permit the strap to be secured around a bottle. A clip or pocket is also attached to the top component in order to hold a pacifier or other small item. Preferably, all of the materials used in making the device are safe enough to withstand machine washing, thus making it practical for daily use. Additionally, advertisements, logos and other insignias could be placed upon the multi-purpose burp cloth, such as favorite sports team logos or catchy slogans, for a more aesthetic appearance.

To use a first embodiment of the present invention as a baby bottle holding burp cloth, the user wraps the strap around the body of the baby bottle, gripping side of the strap against the bottle, and then secures the loose end of the strap to the front side of the cloth by connection the fastening means located on the strap to the fastening means located on the front side of the cloth. The user then positions the baby bottle secured within the strap into the desired height and angle and attaches the strap to the front side via the hook-and-loop type fastener. Once in place, the user can then hold the baby with one hand and have the other hand free to do other tasks.

To use a second embodiment of the present invention as a baby bottle holding burp cloth, the user first places the bottle against the front side of the cloth in between the two straps. The user places the longer strap over the baby bottle and then feeds the longer strap through the adjuster. The user then pulls the longer strap so as to make the strap tight against the bottle and secures the longer strap against the fastening means located on the longer strap.

To use the multi-purpose burp cloth as a diaper changing pad, the user simply flips the burp cloth over so the back side is face up. The user then gently places the baby onto the back side so as the baby's head is resting on the pillow. The user then proceeds to change the baby's diaper.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
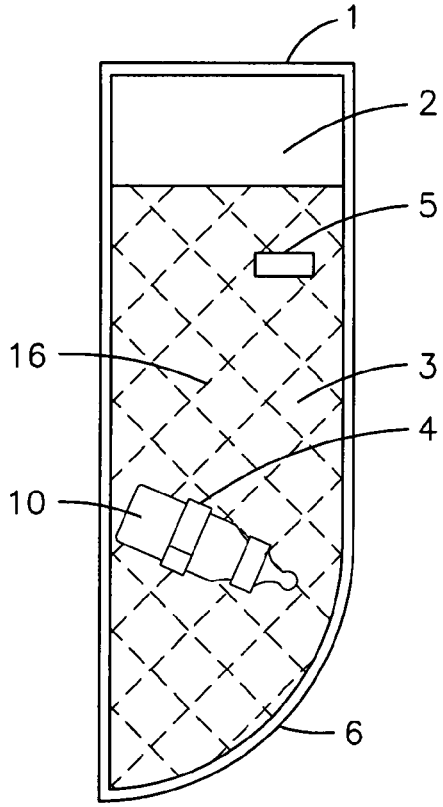
FIG. 1 is a frontal plan view of a first embodiment of the present invention.

For purposes of describing the preferred embodiment, the terminology used in reference to the numbered components in the drawings is as follows:

1. multi-purpose burp cloth
2. pillow
3. front side
4. strap
5. clip
6. border

Figure 2:
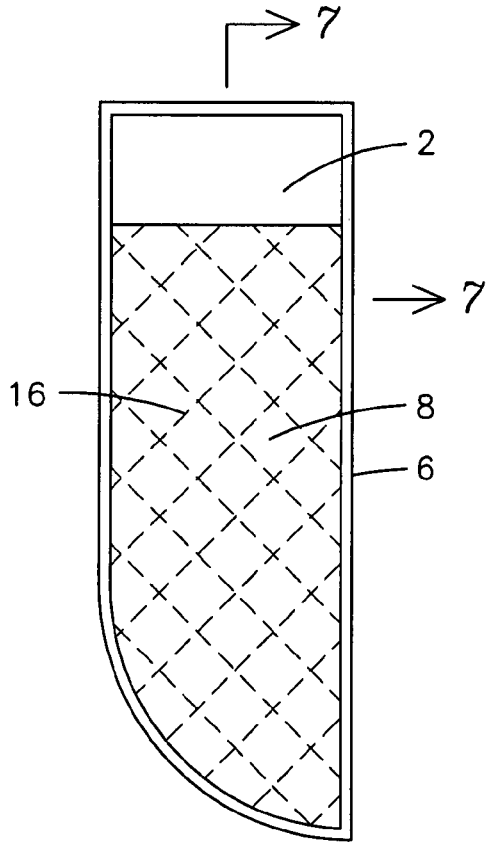
FIG. 2 is a rear plan view of the embodiment of FIG. 1.

-continued 7. adjuster
8. back side
9. grippers
10. baby bottle
11. filling
12. inner face
13. outer face
14. fastening means
15. pacifier
16. stitching
17. elastic
18. longer strap
19. pocket
20. shorter strap
21. baby
22. strap central portion
23. strap first end
24. strap second end With reference to FIGS. 1 and 2, differing views of a first embodiment of the present invention are shown. The multi-purpose burp cloth 1 has a front side 3, preferably made of a soft terry-cloth type material, and a back side 8, preferably made of a vinyl rubber material, that may be attached to each other by cross hatch stitching 16. A border 6 surrounds the entire perimeter of the multi-purpose burp cloth 1 and may be stitched to hold together the layers of the burp cloth 1. A pillow 2, preferably made of a soft material, which may be filled with a compressible material, a plurality of objects, liquid, foam, feathers or the like, is located at an upper portion of the burp cloth 1 and a clip 5 is located just below the pillow 2 on the front side 3. A strap 4 is attached on one end to a lower portion of the front side 3 of the burp cloth 1. The strap 4 may be elasticized in order to expand and stretch around a bottle.

Figure 3:
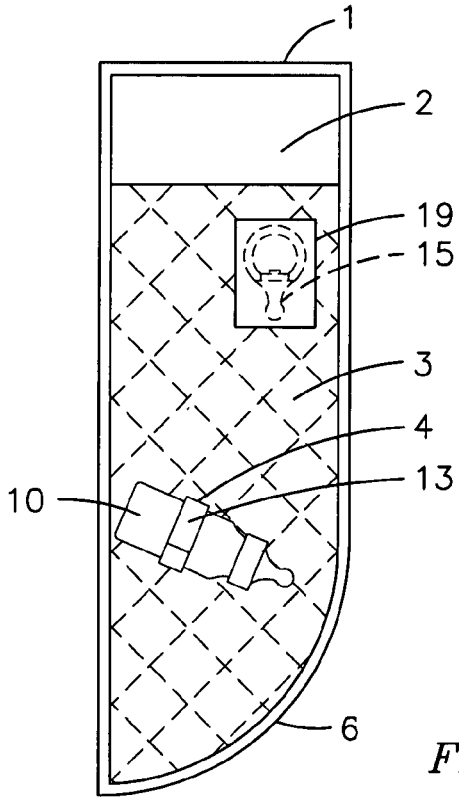
FIG. 3 is a frontal plan view of a first embodiment of the present invention with a pocket.

In FIG. 3, the multi-purpose burp cloth 1 is shown wherein a pocket 19 is located just below the pillow 2 on the front side 3 of the burp cloth 1. The pocket 19 is sized for the acceptance of a pacifier 15 or other similarly sized object. When the strap 4 is wrapped around the bottle 10, the outer face 13 of the strap is visible.

Figure 4:
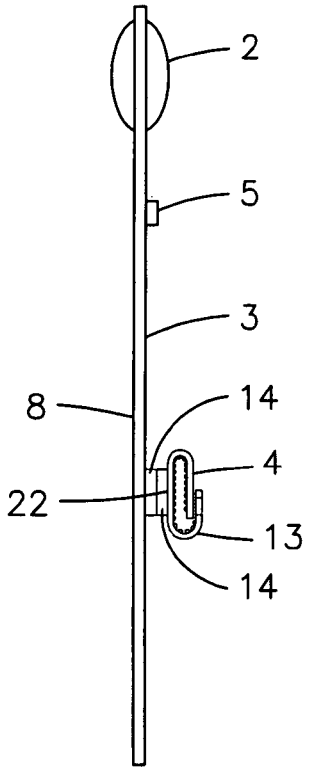
FIG. 4 is distal side view of the embodiment of FIG. 1.

In FIG. 4, a distal side view of the embodiment of FIG. 1 is shown. The pillow 2 has a thickness so as to accommodate and support the head of a baby. The pillow 2 preferably maintains a sufficient amount of weight to also serve as a counter-balance, thus keeping the cloth 1 from falling or sliding off a user's shoulder. A strap central portion 22 may be permanently secured to the front side 3 of the multi-purpose burp cloth 1, although the strap central portion 22 may be releasably secured to the front side 3 by securing a fastening means 14 located on the strap outer surface 13 to a fastening means 14 located on the front side 3 as shown.

Figure 5:
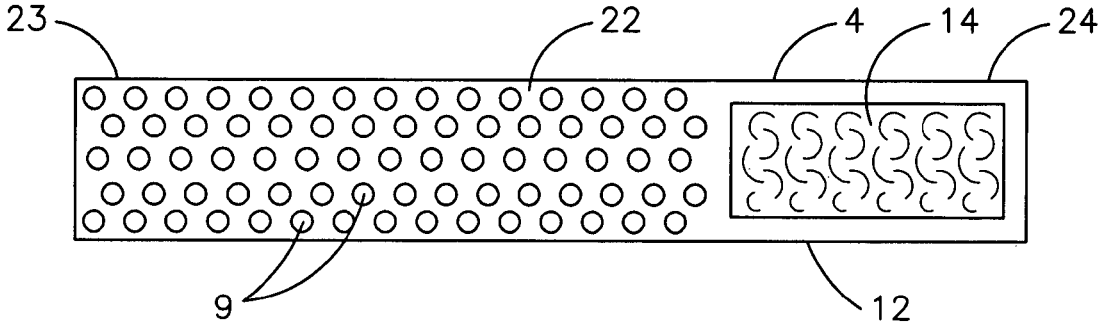
FIG. 5 is an inner view of the strap component of the embodiment of FIG. 1.

In FIG. 5, a front side view of the strap 4 of the embodiment of FIG. 1 is shown. The strap 4 has a first end 23, central portion 22 and second end 24 wherein the strap central portion 22 is located between the first end 23 and the second end 24. The strap also has an inner face 12, preferably having a plurality of grippers 9 located thereon, so as to prevent the baby bottle 10 from slipping out of the strap 4. In addition, a fastening means 14 is preferably located on the strap inner face 12, preferably extending from the central portion 22 to the second end 24.

Figure 6:
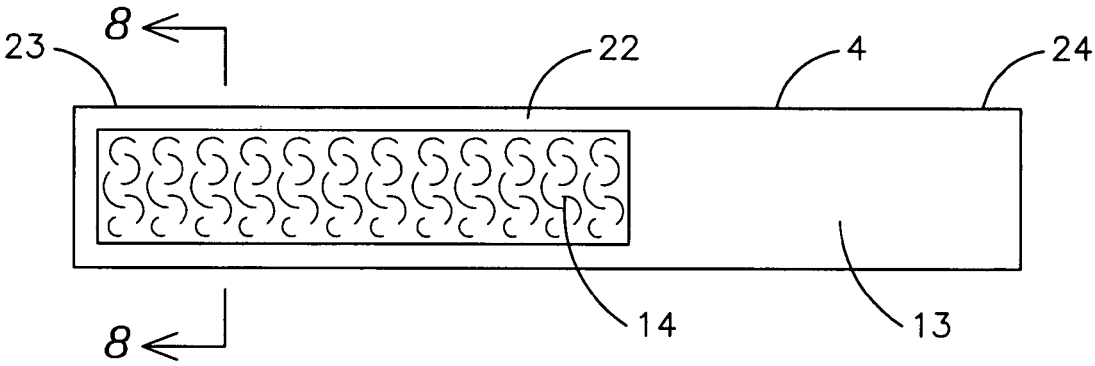
FIG. 6 is an outer view of the strap component of the embodiment of FIG. 1.

With reference to FIG. 6, a rear view of the strap 4 of the embodiment of FIG. 1 is shown. The strap 4 has a first end 23, central portion 22 and second end 24 and has an outer face 13 with a fastening means 14 to attach the fastening means 14 located on the outer surface 13 to the fastening means 14 located on the inner surface 12.

Figure 7:
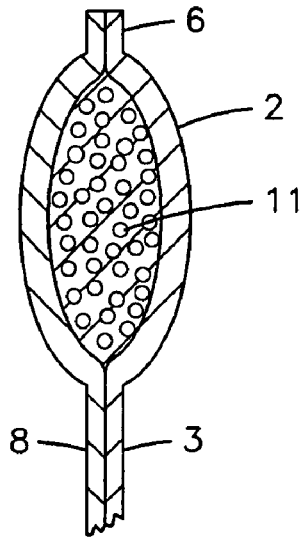
FIG. 7 is cross-sectional view of the pillow component of the invention along the lines 7-7 of the embodiment of FIG. 2.

With reference to FIG. 7, a cross-sectional view along the lines 7-7 of the embodiment of FIG. 2 is shown. The pillow 2 has a filling 11, preferable made of washable bean bag pellets, so as to accommodate and support the head of a baby.

Figure 8:
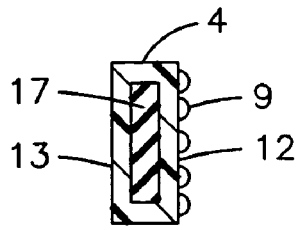
FIG. 8 is a cross-sectional view of the strap component of the invention along the lines 8-8 of the embodiment of FIG. 6.

In FIG. 8, a cross-sectional view along the lines 8-8 of the embodiment of FIG. 6 is shown. The strap 4 is made up of an elastic 17 surrounded by material wherein the outer face 13 is soft while the inner face 12 has grippers 9, preferably small, round, plastic projections, to hold a bottle 10 in place.

Figure 9:
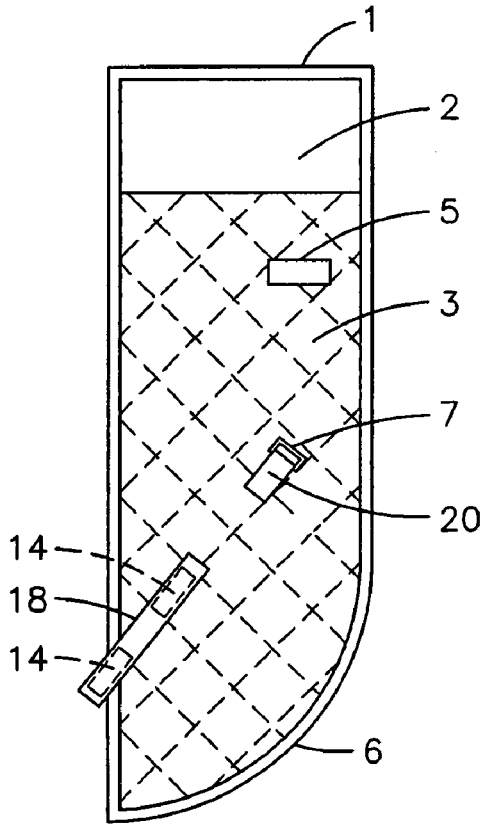
FIG. 9 is a frontal plan view of a second embodiment of the present invention.

With reference to FIG. 9, a second embodiment of the multi-purpose burp cloth 1 is shown wherein two straps and adjuster 7 are used to secure the baby bottle. A longer strap 18 is attached on one end to the front side of the cloth 1 while a shorter strap 20 is also attached on one end to the front side 3 of the cloth 1. An adjuster 7 is secured to an opposite end of the shorter strap 20 wherein the adjuster 7 is a buckle type device. The longer strap 18 has a fastening means, preferably hook and loop type fastening material strip, located on an outer surface of the longer strap 18. The user feeds an opposite end portion of the longer strap 18 through the adjuster 7 and pulls the longer strap 18 so as to make the longer strap 18 tight around the bottle 10. The user then secures the longer strap 18 onto itself by matching the fastening material strips.

Figure 10:
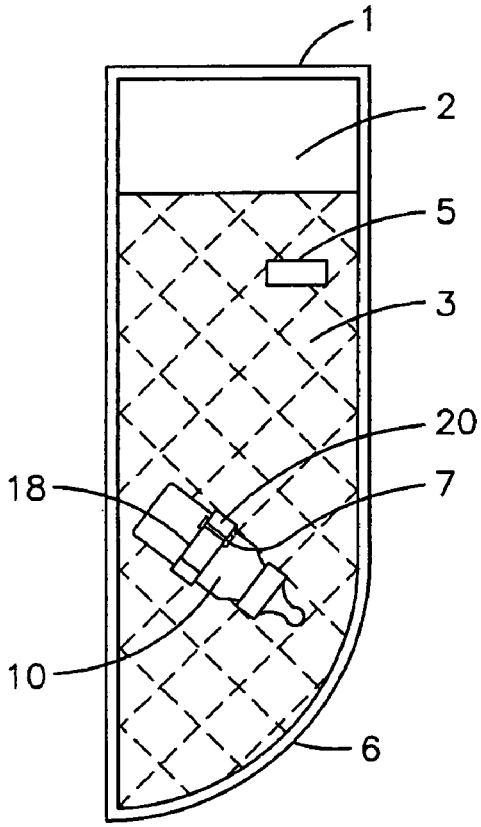
FIG. 10 is a frontal plan view of the embodiment of FIG. 9 holding a baby bottle.

With reference to FIG. 10, a front plan view of the embodiment of FIG. 9 is shown wherein the straps 18 and 20 are holding a baby bottle 10.

Figure 11:
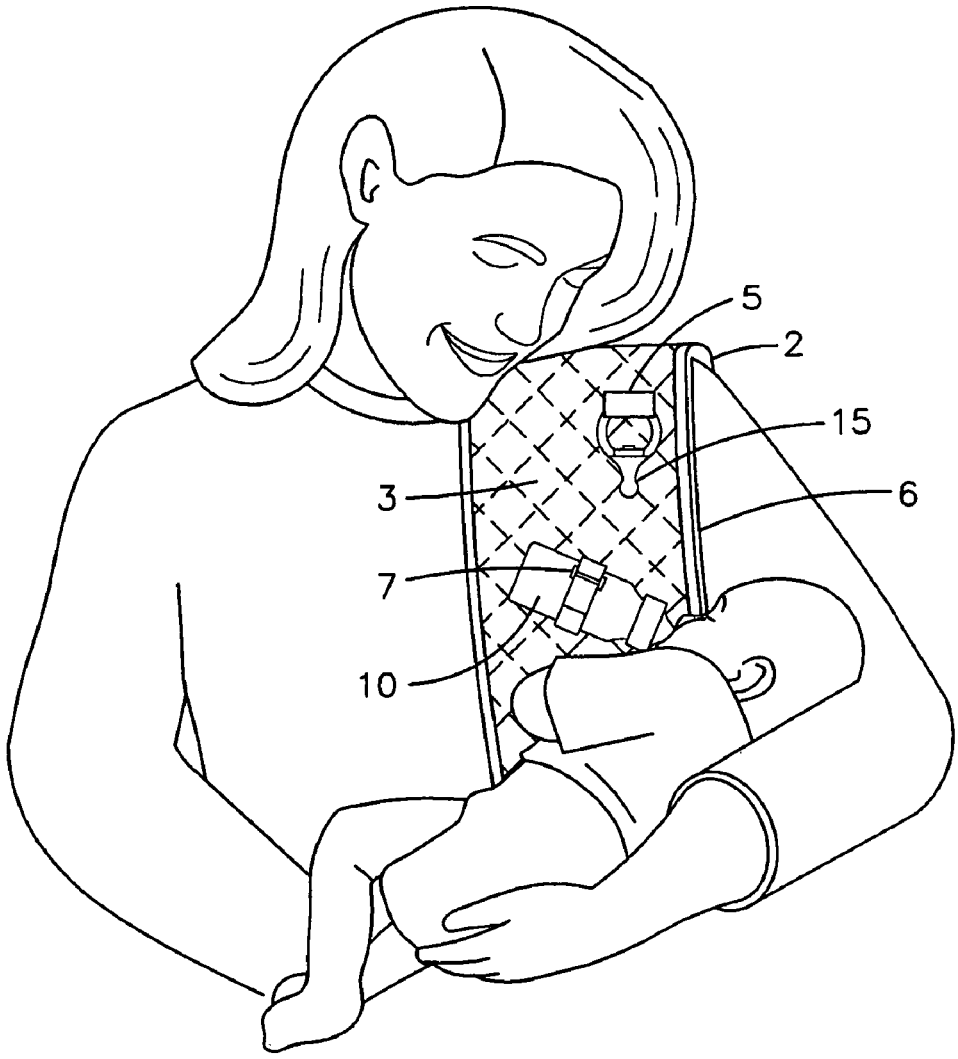
FIG. 11 is a front perspective view of the present invention in use as a baby bottle holding burp cloth.

In FIG. 11, a front perspective view of the embodiment of FIG. 9 in use as a baby bottle holding burp cloth is shown. To use the cloth 1 for this purpose, the user simply wraps the strap 4 around the baby bottle 10 so that the inner face 12 of the strap 4 is against the bottle 10. The user pulls the strap 4 tightly around the bottle to have as much as a secure fit as possible. Because the strap 4 is elasticized and has grippers 9, the bottle 10 will not fall out of the strap 4. The user positions the strap 4 with bottle 10 to a desired angle and attaches the fastening means 14, which is preferably made of a hook-and-loop type fastening material, of the strap 4 onto the front component 3 of the cloth 1 with corresponding fastening means 14. The clip 5 can be used to hold a pacifier 15 or other lightweight item.

Figure 12:
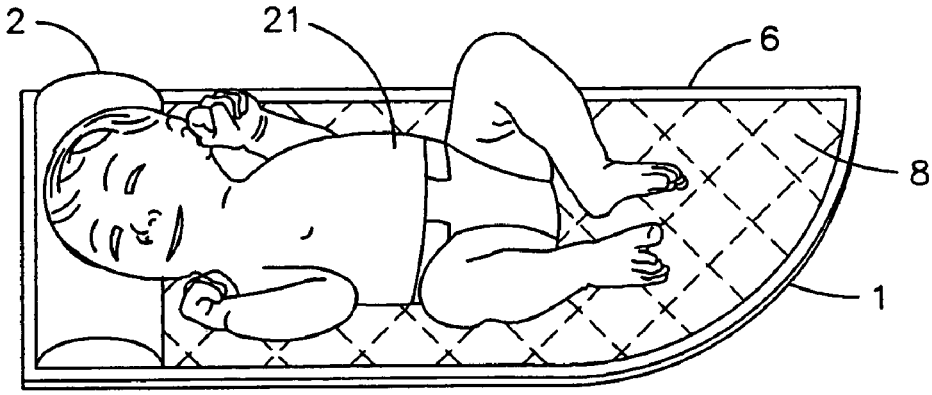
FIG. 12 is a front perspective view of the present invention in use as a diaper changing pad.

With reference to FIG. 12, a front perspective view of the embodiment of FIG. 1 in use as a diaper changing pad is shown. The back side 8 of the cloth 1 is made of an impermeable material, preferably vinyl rubber, so as to promote sanitary conditions. The pillow 2 is sized so as to permit a baby 21 to comfortably rest its head on the pillow 2 while the body of the baby 21 rests on the back side 8 of the cloth 1.

To use the cloth 1 as a diaper changing pad, the user simply flips the cloth 1 over to the back side 8 and places the cloth 1 on a flat surface. The user gently places the baby onto the cloth 1 and positions the baby so that the baby's head is resting on the pillow 2. The user then changes the baby's diaper as usual. Because the back component 8 is preferably made of an impermeable vinyl rubber material, the user can simply wipe the back component 8 with a disinfecting wipe to remove any germs before using the cloth 1 again. Additionally, the entire invention is made of all machine-washable materials so that the user can place the cloth 1 into a washing machine so as to maintain a sanitary condition.

The use of the present invention will allow parents and care-givers the freedom to perform tasks, such as answering the telephone, writing notes or typing on the computer, with one hand while holding a baby that is bottle feeding with the other. Additionally, the use of the present invention will allow parents and care-givers to haul less baby supplies by providing one baby item that has several functions.

It is to be understood that while a certain form of the invention is illustrated, it is not to be limited to the specific form or arrangement of parts herein described and shown. It will be apparent to those skilled in the art that various changes may be made without departing from the scope of the invention and the invention is not be considered limited to what is shown and described in the specification and drawings.

Having thus described my invention, I claim:

1. A multi-purpose burp cloth comprising:

a front side of a predetermined size and shape made of an absorbent material;

said front side having edges;

a back side of same predetermined size and shape as said front side made of an impermeable material attached to said front side;

said back side having edges;

a pillow located at an upper portion of said front side wherein said pillow acts as a weight to maintain said cloth over a user's shoulder;

a strap having a first and a second end;

said strap having an inner face and an outer face;

said strap is attached to said front side of the burp cloth; and said inner face of said strap having a plurality of grippers located thereon.

2. The multi-purpose burp cloth of claim 1 further comprising:

a fastening means located on said strap outer face;

said strap outer face fastening means is a hook and loop type material;

a fastening means located on said strap inner face;

said strap inner face fastening means is a hook and loop type material wherein said strap outer face fastening means corresponds with said strap inner face fastening means.

3. The multi-purpose burp cloth of claim 1 wherein: said absorbent material is terry cloth.

4. The multi-purpose burp cloth of claim 2 wherein: said absorbent material is terry cloth.

5. The multi-purpose burp cloth of claim 1 wherein: said impermeable material is vinyl rubber.

6. The multi-purpose burp cloth of claim 2 wherein: said impermeable material is vinyl rubber.

7. The multi-purpose burp cloth of claim 3 wherein: said impermeable material is vinyl rubber.

8. The multi-purpose burp cloth of claim 1 wherein: said pillow is filled with a compressible material.

9. The multi-purpose burp cloth of claim 2 wherein: said pillow is filled with a compressible material.

10. The multi-purpose burp cloth of claim 3 wherein: said pillow is filled with a compressible material.

11. The multi-purpose burp cloth of claim 1 wherein: said pillow is filled with a plurality of objects.

12. The multi-purpose burp cloth of claim 2 wherein: said pillow is filled with a plurality of objects.

13. The multi-purpose burp cloth of claim 3 wherein: said pillow is filled with a plurality of objects.

14. The multi-purpose burp cloth of claim 1 wherein: said pillow is filled with a liquid.

15. The multi-purpose burp cloth of claim 2 wherein: said pillow is filled with a liquid.

16. The multi-purpose burp cloth of claim 3 wherein: said pillow is filled with a liquid.

17. The multi-purpose burp cloth of claim 8 wherein: said compressible material is foam.

18. The multi-purpose burp cloth of claim 9 wherein: said compressible material is foam.

19. The multi-purpose burp cloth of claim 10 wherein: said compressible material is foam.

20. The multi-purpose burp cloth of claim 11 wherein: said plurality of objects is washable pellets.

21. The multi-purpose burp cloth of claim 12 wherein: said plurality of objects is washable pellets.

22. The multi-purpose burp cloth of claim 13 wherein: said plurality of objects is washable pellets.

23. The multi-purpose burp cloth of claim 11 wherein: said plurality of objects is feathers.

24. The multi-purpose burp cloth of claim 12 wherein: said plurality of objects is feathers.

25. The multi-purpose burp cloth of claim 13 wherein: said plurality of objects is feathers.

26. The multi-purpose burp cloth of claim 1 further comprising:

a fastening means located on said front side; and a fastening means located on said strap outer face wherein said front side fastening means corresponds with said strap outer face fastening means to attach said strap to said front side.

27. The multi-purpose burp cloth of claim 1 wherein: a clip is located on said front side.

28. The multi-purpose burp cloth of claim 27 wherein: said clip is sized to hold a pacifier.

29. The multi-purpose burp cloth of claim 1 wherein: a pocket is located on said front side.

30. The multi-purpose burp cloth of claim 29 wherein: said pocket is sized to accommodate a pacifier.

31. The multi-purpose burp cloth of claim 1 wherein: said front side is attached to said back side by stitching.

32. The multi-purpose burp cloth of claim 1 wherein:

a border surrounds the edges of said front side and said back side; and said border attaches said front side to said back side.

* * * * *